United States Patent [19]

Emms

[11] Patent Number: 4,492,316

[45] Date of Patent: Jan. 8, 1985

[54] TABLET DISPENSER

[75] Inventor: Norman R. Emms, Welwyn Garden, England

[73] Assignee: The Boots Company PLC, Nottingham, England

[21] Appl. No.: 436,555

[22] Filed: Oct. 25, 1982

[30] Foreign Application Priority Data

Oct. 24, 1981 [GB] United Kingdom ..... 8132142

[51] Int. Cl.[3] ..... B65G 59/06

[52] U.S. Cl. ..... 221/202; 221/243; 221/264; 206/540

[58] Field of Search ..... 206/540; 221/21, 156, 221/157, 163, 200, 202, 204, 243, 251, 263, 264, 268, 289, 292, 293, 312 C, 312 R

[56] References Cited

U.S. PATENT DOCUMENTS

| | | | |
|---|---|---|---|
| 2,669,349 | 2/1954 | Silver | 221/202 |
| 2,792,922 | 8/1952 | Malhoit | 221/243 X |
| 2,892,569 | 6/1959 | Sinclair | 221/299 |
| 4,402,425 | 9/1983 | Von Schuckmann | 221/202 |
| 4,405,060 | 9/1983 | Hsei | 221/200 X |

FOREIGN PATENT DOCUMENTS

| | | |
|---|---|---|
| 2538904 | 3/1977 | Fed. Rep. of Germany . |
| 8003303 | 6/1980 | Fed. Rep. of Germany . |
| 2922350 | 12/1980 | Fed. Rep. of Germany . |
| 3014806 | 10/1981 | Fed. Rep. of Germany . |
| 3016834 | 11/1981 | Fed. Rep. of Germany . |
| 3018041 | 11/1981 | Fed. Rep. of Germany . |
| 3022411 | 1/1982 | Fed. Rep. of Germany . |
| 2492343 | 11/1980 | France . |
| 2496060 | 12/1980 | France . |
| 789865 | 1/1958 | United Kingdom . |
| 1062013 | 3/1967 | United Kingdom . |
| 1062497 | 3/1967 | United Kingdom . |
| 1075697 | 7/1967 | United Kingdom . |
| 1281517 | 7/1972 | United Kingdom . |
| 1319761 | 6/1973 | United Kingdom . |
| 1385900 | 3/1975 | United Kingdom . |
| 1467703 | 3/1977 | United Kingdom . |
| 1486878 | 9/1977 | United Kingdom . |
| 2013636 | 8/1979 | United Kingdom . |
| 1604037 | 12/1981 | United Kingdom . |
| 2082147 | 3/1982 | United Kingdom . |

*Primary Examiner*—H. Grant Skaggs
*Assistant Examiner*—Lawrence J. Miller
*Attorney, Agent, or Firm*—Lawrence Rosen

[57] ABSTRACT

A dispenser of dispensing tabets one at a time has a reservoir, a chamber below the reservoir in which the tablets are arranged in a single layer and a dispensing passageway which leads to a dispensing orifice. The passageway is of such a width that a single column of tablets can be accommodated. The passageway is defined by portions of a moving slider member and can be moved from a non-dispensing position to a dispensing position. In this latter position the lowermost tablet is dispensed whereas the remaining tablets in the column are retained in the passageway by a fixed protuberance. One side of the passageway is resilient to minimize tablet damage. The slider member is adapted to assist the passage of tablets from the reservoir to the chamber.

3 Claims, 6 Drawing Figures

TABLET DISPENSER

Field of the Invention

The present invention relates to containers for the storage and dispensing of tablets. Such containers are herein after referred to as dispensers.

The dispenser may be used for medicinal tablets or for tablets containing an artifical sweetening agent, for example, saccharin. In order that the medicinal dose or the degree of sweetening can be controlled, a dispenser is required which dispenses tablets one at a time. The present invention aims to provide such a dispenser.

SUMMARY OF THE THE INVENTION

The present invention relates more specifically to a dispenser for dispensing tablets one at a time which comprises (a) an outer casing containing a reservoir in which the tablets are randomly orientated, (b) means for causing the tablets to be transferred from the reservoir and to become arranged in a single layer in a chamber which feeds the tablets into a dispensing passageway which is of such a width that only a single column of abutting tablets can be accomodated, (c) a slider mechanism having portions which define the width of the dispensing passageway, said slider mechanism being moveable within the outer casing from a first position in which the column of abutting tablets is contained within the outer casing and a second tablet dispensing position in which the column of abutting tablets is aligned with a dispensing opening in the outer casing, said slider mechanism being provided with means whereby it is urged towards the first position, and (d) a projection which is fixed in position relative to the outer casing in such a position that the projection is not aligned with the column of abutting tablets when the slider mechanism is in its first position but, when the slider mechanism is in its second dispensing position, the projection is aligned with the column of abutting tablets and is interposed between the tablet adjacent the dispensing opening and the remaining tablets in the column to retain the remaining tablets within the passageway so that only the tablet adjacent the dispensing opening can pass through that opening and in which one of said portions of the slider mechanism which define the width of the dispensing passageway is resilient so that in the event of a tablet being trapped between said one of said portions and the projection, said one of the portions will deform to minimise damage to the tablet as the slider mechanism is moved from the first to the second position.

The means for causing the tablets to be transferred and to be arranged in a single layer in the chamber may comprise a portion of the slider mechanism which is located adjacent the exit from the reservoir and which, as the slider mechanism is moved between the first position and the second, agitates the tablets near the exit and causes some of the tablets to attain the correct orientation to fall into the chamber. The portion of the slider mechanism may be serrated.

The means for urging the slider mechanism towards the first position may comprise an integrally-formed resilient portion of the slider mechanism.

A BRIEF DESCRIPTION OF THE DRAWINGS

The invention will be illustrated by the following description of an embodiment thereof which is given by way of example only and has reference to the accompanying drawings in which:

FIG. 1 is an exploded perspective view showing the components of one embodiment of dispenser, FIG. 2 is a cross-sectional view of an assembled dispenser, FIG. 3 is a cross-sectional view of one of the components shown in FIG. 1 taken along the line III—III of FIG. 1, FIG. 4 is a plan view of another of the components shown in FIG. 1 taken in the direction of the arrow IV in FIG. 1, and FIGS. 5*a* and 5*b* are diagrammatic representations illustrating the operation of the dispenser.

DETAILED DESCRIPTION OF THE INVENTION

Figure 1:
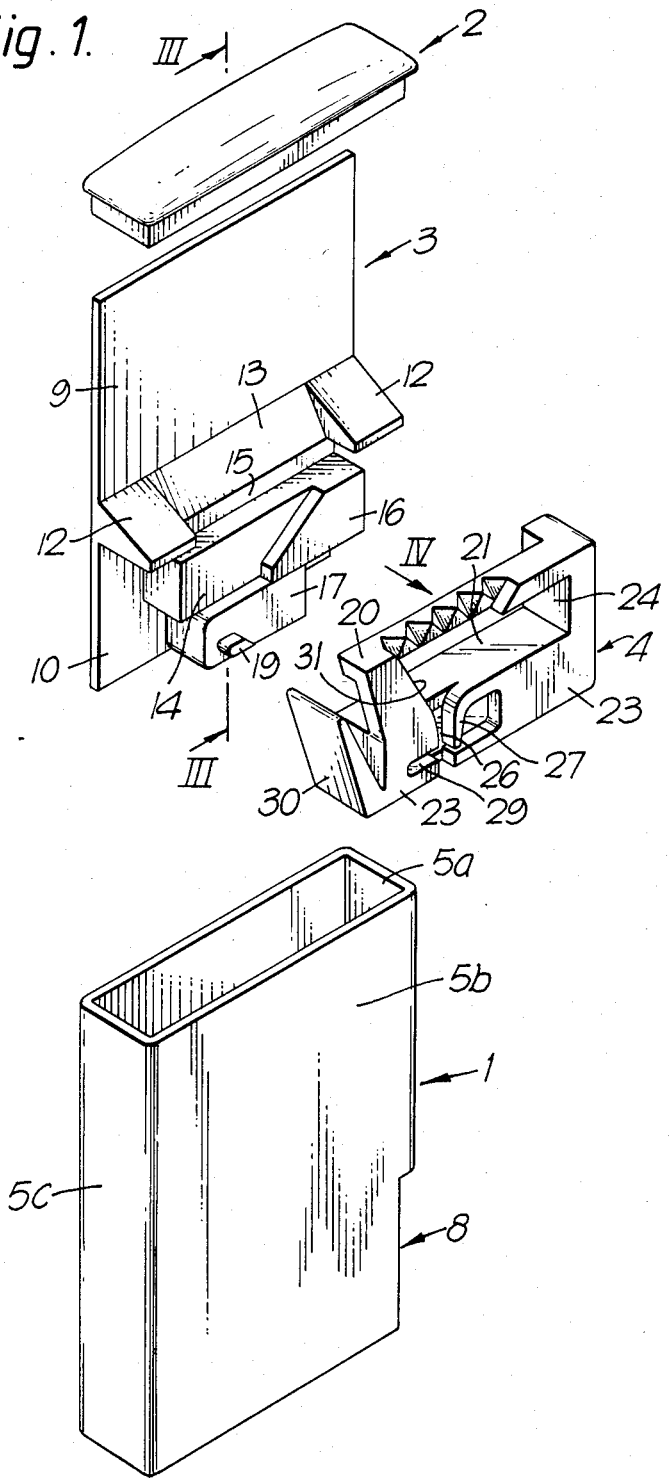

The dispenser as shown comprises four parts which are produced from plastics materials for example by injection moulding. These parts are a body portion 1, a lid portion 2, an inner portion 3 and a slider portion 4.

The lid portion 2 interengages with the upper open end of the body portion 1 in the embodiment shown. However, in an alternative embodiment, the body portion 1 and lid portion 2 may be moulded in one piece and connected by an integrally moulded hinge portion (not shown). The body portion 1 is a generally cup-shaped member having a peripheral wall 5 and a base 6 having a tablet dispensing opening 7. An opening 8 in the peripheral wall 5 and base 6 is provided to enable the slider portion 4 to be manipulated when the assembled dispenser is in use. The body portion may comprise any suitable plastics material but polystyrene, polypropylene, ABS or phenolformaldehyde are the preferred materials.

Figure 3:
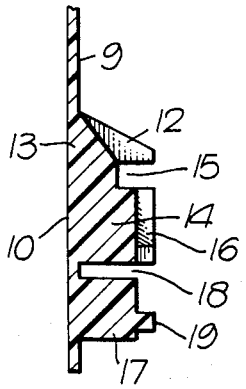
Figure 4:
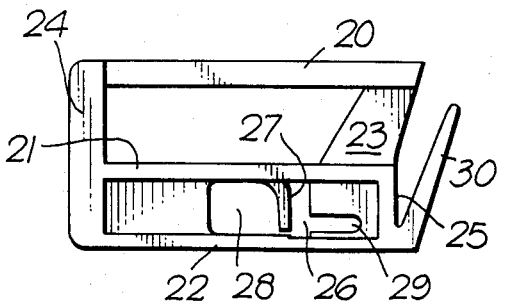

The inner portion 3 is a sliding fit inside the body portion 1 and comprises a flat rear member which comprises two rectangular flat members 9, 10. The upper flat member 9 together with the front wall 5*b* and the side walls 5*a*, 5*c* of the peripheral wall 5 and the lid portion 2 defines a reservoir 11 in which a supply of tablets to be dispensed can be stored. The lower end of the reservoir 11 is defined partly by a line of sloping projections 12, 13 of which the outermost projections 12 extend across the full width of the interior of the body portion 1. The projections 12 may be angled so that they also have a slope which directs tablets towards the center of the dispenser. This alternative embodiment is not shown in the Figures. The central projection 13 extends only part way across the width of the interior of the body portion 1 and with the front wall 5*b* of the body portion defines a rectangular slot in the base of the reservoir 11 through which pass the tablets to be dispensed. The lower flat member 10 is also rectangular but has less width than the upper flat member 9 to leave a cut-away portion at the right hand edge when the inner member 3 is in the orientation shown in FIG. 1. The lower flat member 10 has two projections. The first and uppermost projection 14 is sustantially rectangular in shape and extends parallel to and below the line of projections 12, 13 from the right hand edge of the lower flat member 10, but it does not extend the full width of the lower flat member 10. As can be seen more clearly from FIG. 3 the projection 14 has a stepped portion 15 which together with the projection 12 provides a guide to receive the slider component 4 as will be described later. The projection 14 also has a generally trapezoid projection 16 which provides a sloping ramp down which tablets to be dispensed can move. Below the projection 14 is a further projection 17 which is spaced from the projection 14 by a groove 18. The projection 17 has a tablet separating protuberance 19 extending from its otherwise planar upper surface. The inner portion is preferably manufactured in one piece for example by injection moulding. Suitable plastics materials include polystyrene, polypropylene, ABS and phenol-formaldehyde resins.

Figure 2:
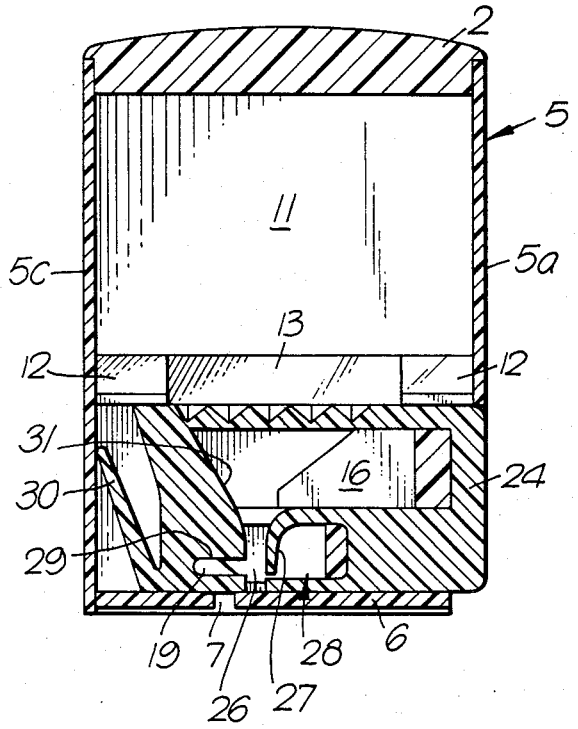

The slider portion 4 is provided with projecting plates 20, 21, 22 which are held in parallel spaced relationship by a front plate 23 and an end plate 24. The plates 21, 22 extend the full width of the slider portion 4 whereas the uppermost projecting plate 20 extends only partly across the width of the slider portion. In the assembled dispenser the slider portion 4 is located on the inner portion 3 with the uppermost projecting plate 20 located on the stepped portion 15 of the projection 14, the plate 21 is located within the groove 18 and the plate 22 is located below the projection 17. The slider portion when assembled with the inner portion 3 is able to slide from side to side but the amount of travel towards the right as shown in Figures is limited because a wall 25 of the slider portion contacts the projection 17 and the amount of travel towards the left as shown is limited because the end plate 24 contacts the right hand end of the projection 14. The front plate is formed with a tablet dispensing opening 26 which is bounded on one side by a resilient finger 27 which can flex into the cut-away aperture 28. The opposite side of the opening is provided with a slot 29 which receives the projection 19 when the inner portion 3 is assembled with the slider portion 4. The slider member has a spring member 30 which urges the slider portion to move to the right as shown in FIG. 2. In an alternative the member 30 may be replaced by a spring. The upper surface of the plate 20 is serrated so as to cause agitation of the tablets to be dispensed. The front wall 23 of the slider portion 4 has a sloping ramp surface 31 located below the serrations in the plate 20. The slider member 4 is preferably manufactured in one piece for example by injection moulding from a plastics material such as acetal, nylon, polypropylene or high density polyethylene.

Figure 5A:
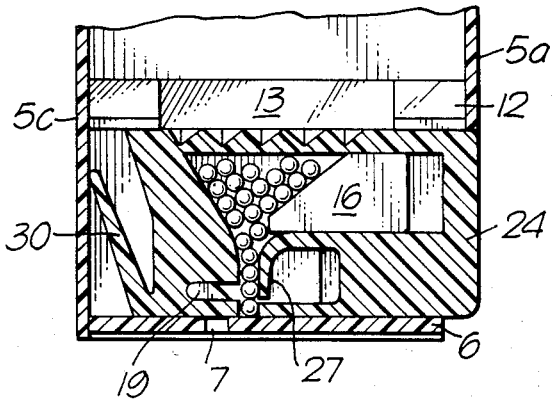
Figure 5B:
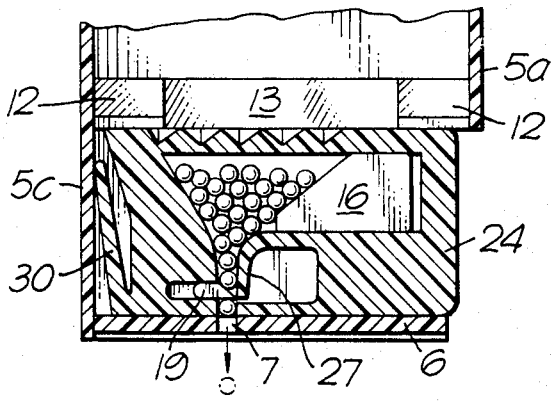

The assembly and operation of the dispenser will now be described. The slider portion 4 is placed on the inner portion 3 and these two components are slid into the outer portion 1. The components will then take up the positions shown in FIG. 2 with the end wall 24 of the slider portion 4 extending through the opening 8 in the outer portion 1. The reservoir 11 is then filled with tablets and the lid portion 2 placed in position. It is intended that the dispenser will be used in an upright position and that the tablets will be right-cylindrical in shape. The dispenser would however also function if the reservoir 11 was loaded with spherical pills. The tablets will fall to the bottom of the reservoir and some of them will fall through the rectangular slot in the base of the reservoir into a generally triangular chamber defined by the projection 14 at the rear, the front wall **5*b* of the body portion at the front and the generally trapezoid projection 16 and the sloping ramp surface 31 of the slider portion 4 at the sides. The projection 14 and front wall 5*b* is spaced so that the right-cylindrical tablets can only be located in the triangular chamber with their planar surfaces facing the projection 14 and front wall 5*b* respectively. The tablets are agitated when the slider is moved relative to the inner member 3 by the serrations in the plate 20 so that they take up the correct orientation to fall into the triangular chamber. From the base of the triangular chamber a column of tablets forms in the passageway formed by the planar surfaces of the interior of the front wall 5*b* and the projection 17 and the opening 26. The column of tablets is prevented from falling because the lowermost tablet contacts the base 6 of the outer portion 1. (FIG. 5*a*). As the slider portion 4 is moved to the left as the user presses the end wall 24 of the slider portion the column of tablets is also moved to the left. The protuberance 19 separates the lowermost tablet from the remainder of the tablets in the column and allows the lowermost tablet to fall through the dispensing opening 7 in the base of the dispenser whilst supporting the remainder of the column within the dispensing passageway (FIG. 5*b*). As the slider member is moved to the left the spring member 30 is deformed as shown in FIG. 5*b*. When the user releases the pressure on the end wall 24 the spring member reverts to the orientation shown in FIG. 5*a*. The tablets in the column then fall to fill the column with the lowermost tablet in contact with the base of the outer member 1**.

The protuberance 19 is shaped so that as the slider member 4 is moved into the casing and the column of tablets is moved towards the tapered leading edge of the protuberance, the column is separated so that only a single tablet is transported to the dispensing orifice. If however there are damaged or mis-shaped tablets it is possible that the protuberance will not be aligned with the space between the lowermost tablet and the one immediately above it. Under these circumstances a tablet may be urged into contact with the tapered leading edge of the protuberance which could cause the tablet to be damaged. However the resilient finger 27 will flex under these conditions to minimize the damage done to the tablet.

I claim:

1. A dispenser for dispensing tablets one at a time which comprises an outer casing containing a reservoir in which the tablets are randomly orientated, means for causing the tablets to be transferred from the reservoir and to become arranged in a single layer in a chamber which feeds the tablets into a dispensing passageway which is of such a width that only a single column of abutting tablets can be accomodated, a slider mechanism, having portions which define the width of the dispensing passageway, said slider mechanism being moveable within the outer casing from a first position in which the column of abutting tablets is contained within the outer casing and a second tablet dispensing position in which the column of abutting tablets is aligned with a dispensing opening in the outer casing, said slider mechanism being provided with means whereby it is urged towards the first position, a projection which is fixed in position relative to the outer casing in such a position that the projection is not aligned with the column of abutting tablets when the slider mechanism is in its first position but, when the slider mechanism is in its second dispensing position, the projection is aligned with the column of abutting tablets and is interposed between the tablet adjacent the dispensing opening and the remaining tablets in the column to retain the remaining tablets within the passageway so that only the tablet adjacent the dispensing opening can pass through that opening, said means for causing the tablets to be transferred comprising a serrated portion of the slider mechanism which is located adjacent the exit from the reservoir and which, as the slider mechanism is moved between the first position and the second, agitates the tablets near the exit and causes some of the tablets to attain the correct orientation to fall into the chamber, and one of said portions of the slider mechanism which define the width of the dispensing passageway being resilient so that in the event of a tablet being trapped between said one of said portions and the projection, said one of the portions will deform to minimize damage to the tablet as the slider mechanism is moved from the first to the second position.

2. A dispenser as claimed in claim 1 in which said means for urging the slider mechanism towards the first position comprises an integrally-formed resilient finger on the slider mechanism.

3. A dispenser as claimed in claim 1 which comprises an inner member which is located within the outer casing, said inner member having sloping projections for directing tablets leaving the reservoir towards the serrated edge of the slider mechanism, a first projection which, together with the slider mechanism and the outer casing, defines said chamber, a second projection which carries the fixed projection and which has a planar surface which forms one face of the dispensing passageway, grooves between the sloping projections and the first projection and between the first and second projections which receive corresponding flanges on the slider mechanism, said first and second projections being so formed that in the second and first positions respectively of the slider mechanism they contact wall portions of the slider mechanism which separate the flanges.

* * * * *